US007097461B2

(12) United States Patent
Neidlein

(10) Patent No.: US 7,097,461 B2
(45) Date of Patent: Aug. 29, 2006

(54) ELECTRIC CONNECTING DEVICE

(75) Inventor: Hermann Neidlein, Steinheim (DE)

(73) Assignee: Magcode AG, Heidenheim (DE)

( * ) Notice: Subject to any disclaimer, the term of this patent is extended or adjusted under 35 U.S.C. 154(b) by 0 days.

(21) Appl. No.: 10/527,478

(22) PCT Filed: Sep. 8, 2003

(86) PCT No.: PCT/EP03/09963

§ 371 (c)(1),
(2), (4) Date: Apr. 21, 2005

(87) PCT Pub. No.: WO2004/027936

PCT Pub. Date: Apr. 1, 2004

(65) Prior Publication Data

US 2005/0255719 A1 Nov. 17, 2005

(30) Foreign Application Priority Data

Sep. 13, 2002 (DE) ..... 102 42 646

(51) Int. Cl.
*H01R 12/00* (2006.01)

(52) U.S. Cl. ..... 439/66; 439/39

(58) Field of Classification Search ..... 439/66, 439/39, 38, 91, 591
See application file for complete search history.

(56) References Cited

U.S. PATENT DOCUMENTS

| | | | | |
|---|---|---|---|---|
| 3,810,258 | A | 5/1974 | Mathauser | |
| 5,385,477 | A * | 1/1995 | Vaynkof et al. | 439/66 |
| 5,531,022 | A * | 7/1996 | Beaman et al. | 29/850 |
| 6,030,229 | A * | 2/2000 | Tsutsui | 439/39 |
| 6,350,076 | B1 * | 2/2002 | Wagner et al. | 403/135 |
| 6,561,815 | B1 | 5/2003 | Schmidt | |
| 6,796,810 | B1 * | 9/2004 | DelPrete et al. | 439/86 |
| 6,869,289 | B1 * | 3/2005 | Sabatier et al. | 439/66 |
| 2002/0014350 | A1 * | 2/2002 | Distefano et al. | 174/251 |
| 2002/0155735 | A1 * | 10/2002 | Zhou et al. | 439/66 |
| 2002/0182898 | A1 * | 12/2002 | Takahashi et al. | 439/39 |
| 2005/0095880 | A1 * | 5/2005 | Macintyre | 439/66 |
| 2005/0233610 | A1 * | 10/2005 | Tutt et al. | 439/66 |

FOREIGN PATENT DOCUMENTS

| | | |
|---|---|---|
| CH | 681 121 A | 1/1993 |
| DE | 44 08 652 A | 9/1995 |
| EP | 0 573 471 B1 | 2/1992 |
| FR | 2 566 195 A | 12/1985 |
| WO | WO 95 08910 A | 3/1995 |
| WO | WO 01 03249 A | 1/2001 |

* cited by examiner

*Primary Examiner*—Gary F. Paumen
(74) *Attorney, Agent, or Firm*—Davis & Bujold, P.L.L.C.

(57) ABSTRACT

An electrical connecting device has the following features: a current or data transmitter device which can be connected to at least one current-transmitting or pulse-transmitting source is arranged in a transmitter housing and has contact elements. A current receiving or data receiving device, which can be electrically connected to a load or a consumer is arranged in a receiver housing and has contact elements. A current, pulse or data transfer can be produced between the contact elements (which are in the form of flat contacts with touching surfaces) by connection of the current or data transmitter device to the current receiving or data receiving device. A large number of contact elements of at least one of the two devices are arranged alongside one another in a configuration in the form of an array. The contact elements which are inserted into the configuration in the form of an array are elastically mounted. The configuration in the form of an array rests on a pressing link.

12 Claims, 2 Drawing Sheets

ELECTRIC CONNECTING DEVICE

This application is a national stage completion of PCT/EP2003/009963 filed Sep. 8, 2003 which claims priority from German Application Serial No. 102 42 646.5 filed Sep. 13, 2002.

FIELD OF THE INVENTION

The invention relates to an electrical connecting device of the type defined in more detail in the precharacterizing clause of claim 1.

A connecting device of this type is described in WO 01/03249 A1.

The elastic arrangement of the contact elements of at least one device also allows two or more contacts to be optimally aligned with respect to one another, and allows a very good surface contact to be made. This allows even relatively high ampere levels to be transmitted and passed on.

BACKGROUND OF THE INVENTION

The present invention is based on the object of further improving the already known electromechanical connecting device, in particular in order to make it even more suitable for large-scale production and for a large number of contact connections.

SUMMARY OF THE INVENTION

According to the invention, this object is achieved in that a large number of contact elements of at least one of the two devices are arranged alongside one another in a configuration in the form of an array, in that the contact elements which are inserted into the configuration in the form of an array are elastically mounted, and in that the configuration in the form of an array rests on a pressing link on the side facing away from the contact elements.

The arrangement of the contact elements of at least one device in the configuration in the form of an array allows a large number of contact connections to be made in a very confined space. In practice, the contact elements are arranged alongside one another like letters in a printing press, in which case the length can be chosen virtually as required. The elastic mounting means that the individual contact elements can move independently of one another, thus resulting in optimum contact connections with flat contact. The pressing link likewise ensures a good flat contact owing to the common mounting and the fact that the contact elements are supported on their rear face. The elasticity required for the contact elements can be achieved, in one very advantageous refinement of the invention, by the pressing link being elastic. In addition to providing a very good surface contact, an elastic pressing link also allows tolerance inaccuracies to be compensated for. At the same time, the pressure is in this case distributed uniformly over the individual contact elements.

Additionally or alternatively, the contact elements may be at least partially embedded in an elastic sheath.

If necessary, the device can be lengthened as required on the basis of the frame which is in the form of an array, in a similar manner to printing letters.

One advantageous refinement of the invention allows the current or data transmitter device and the current receiving or data receiving device each to be provided with magnet bodies with the magnet bodies for the current receiving or data receiving device being arranged opposite the magnet bodies of the current transmitter or data transmitter device.

The device according to the invention allows an almost blind flat contact to be made with pinpoint accuracy, over a very short distance and with the ability to accept relatively large tolerances between the parts that are to be electrically connected.

One advantageous design refinement allows the configuration in the form of an array to be formed by a frame, in which case the frame may at least approximately have a meandering shape which runs with right-angled turns.

The meandering shape according to the invention makes it possible to form a frame which is in the form of an array and can be cut appropriately to any desired length, effectively in the form of a blank which can be cut to length. The contact elements are then pushed into the individual meanders and are advantageously provided with the elastic sheath by injection molding, in which case the individual meanders can be filled in a corresponding manner with the injection molded material. However, those meanders which are open to the rear can also be left free so that the air gap that that results in allows the elasticity to be increased. If the meander width is in this case made slightly narrower than the thickness of the contact elements, then they are held securely by a clamping effect in the meanders which project forwards.

In order to enlarge the surface contact, it is possible to provide for two contact elements which are located alongside one another to be connected to one another by a conductive link part.

In this situation, two contact elements in the respective other device are also, of course, likewise connected to one another by means of a conductive link part. This allows a considerably larger contact area to be created, so that even greater currents can be transmitted at this point.

Instead of the current or data transmitter device being connected to the current receiving or data receiving device via the magnet bodies by production of a magnetic attraction force, the two devices may also, of course, be connected to one another in any other desired manner, for example by a force-fitting or interlocking connection, with or without locks.

BRIEF DESCRIPTION OF THE DRAWINGS

Advantageous developments and refinements will become evident from the other dependent claims and from the exemplary embodiment, which is described in principle in the following text with reference to the drawing, in which:

DETAILED DESCRIPTION OF THE INVENTION

Figure 1:
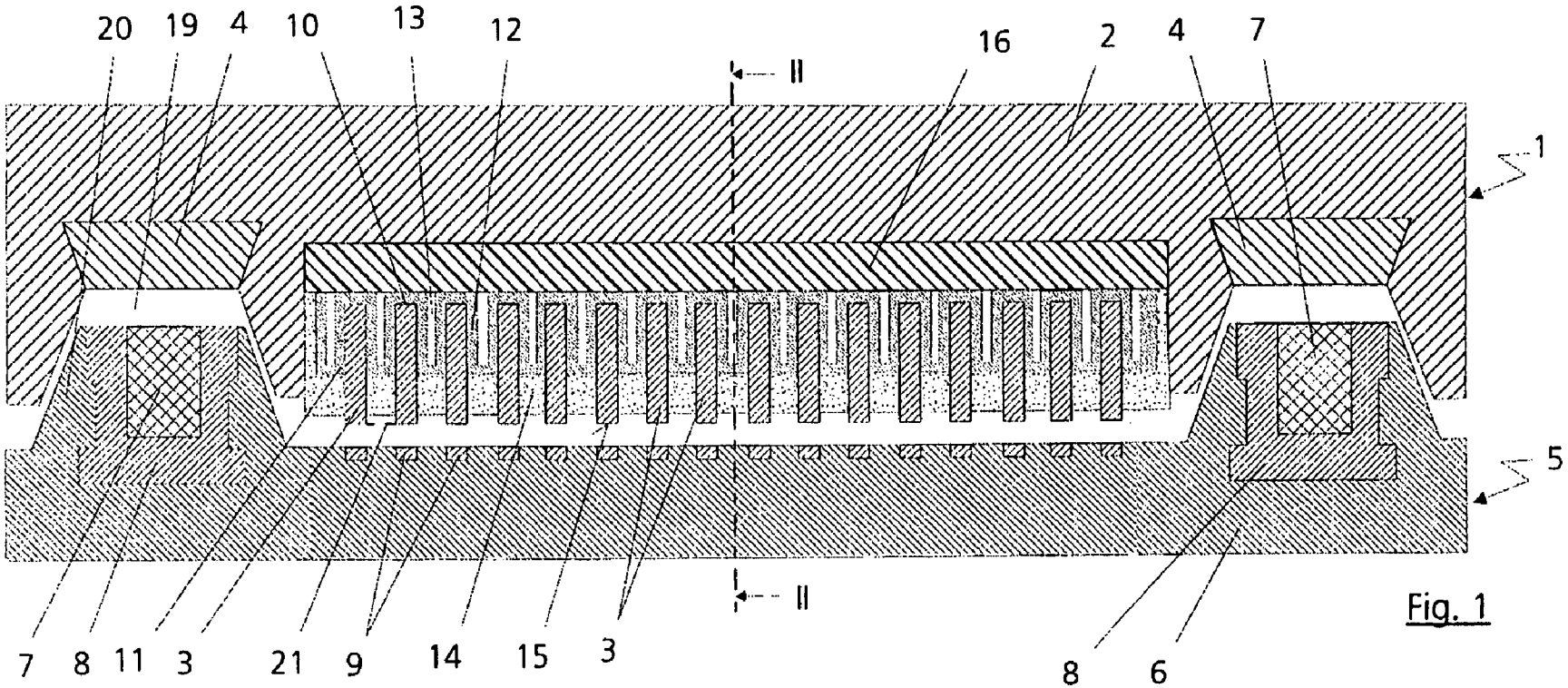
FIG. 1 shows a longitudinal section through the electrical connecting device according to the invention, along the line I—I in FIG. 2.
Figure 2:
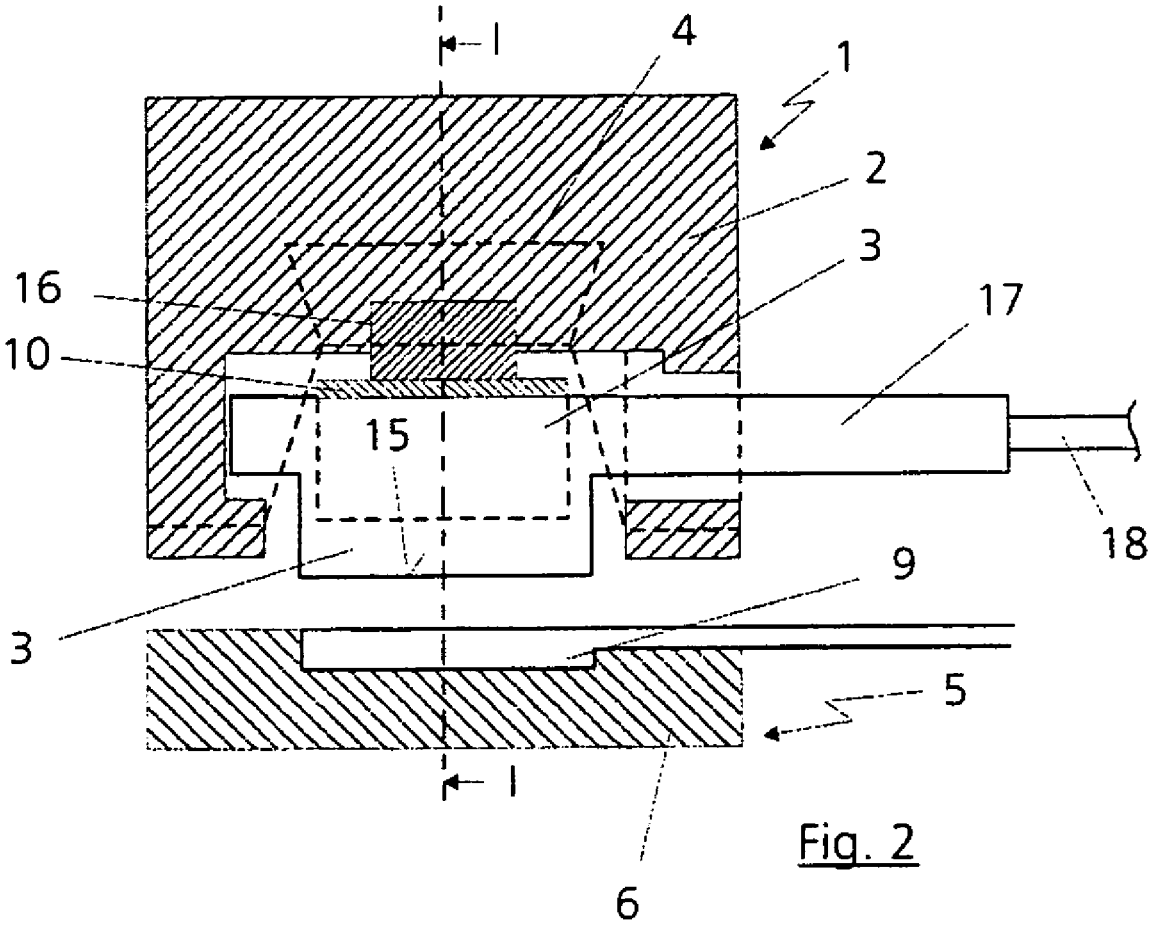
FIG. 2 shows a cross section through the electrical connecting device according to the invention, along the line II—II in FIG. 1; and the field of use and application for the electrical connecting device may be the same as that described in WO 01/03249 A1. WO 01/03249 A1 at the same time in this case also represents the disclosure content of the present invention, where this is not described in any more detail in the following text.

FIGS. 1 and 2 each show a current or data transmitter device 1 with a housing 2, in which a large number of contact elements 3 in the form of flat contacts alongside one another are arranged. Two, or else more if necessary, magnet bodies 4 in the form of iron cores or of magnets are arranged at a distance from one another in the transmitter housing 2.

For an electrical connection, a current receiving or data receiving device 5 together with a receiver housing 6 are arranged opposite the current or data transmitter device 1 in such a way that magnets or magnet bodies 7 which are arranged in the receiver housing 6 are opposite the magnet bodies 4 which are arranged in the transmitter housing 2. If the magnet bodies 7 are in the form of magnets, and the magnet bodies 4 are in the form of iron cores, then there is no need to pay attention to the need for opposite polarity. If the magnet bodies 4 are likewise in the form of magnets, care must be taken to ensure that opposite poles are in each case arranged opposite one another.

In order to reinforce the magnetic force, the magnets 7 may additionally also be sheathed with an iron casing 8, thus increasing the magnetic force. Refinements of magnets such as these are generally known, and will therefore not be described in any more detail.

For simplicity, the following text discusses only one current transmitter device 1 and one current receiving device 5. The two devices are, of course, also suitable for data transmission in the sense of a data transmitter device and a data receiving device.

The expression magnet bodies refers in an entirely general form to magnets, parts which can be magnetized or magnetic parts which react magnetically under the influence of a magnet. The only important factor is that the magnet bodies 4 of the current transmitter unit 1 and those of the current receiving device 5 interact in such a way that a magnetic attraction force is produced on both parts by means of a magnetic field.

The current receiving device 5 is likewise provided with contact elements 9 in the form of flat contacts, which are arranged alongside one another in the receiver housing 6 in such a way that they are each arranged opposite the contact elements 3 in the current transmitter unit 1 when the current transmitter device 1 is connected to the current receiving device 5.

FIGS. 1 and 2 each show the position shortly before the current transmitter device 1 makes contact with the current receiving device 5, and thus shortly before a contact connection is made between the contact elements 3 and 9.

The contact elements 3 in the current transmitter device 1 are arranged in a configuration in the form of an array, in the form of a frame 10, which is in the form of an array, in its cutouts. The frame 10 in the form of an array has a meandering shape with right-angled turns, with the contact elements 3 in each case being inserted in a meander or a cutout between two ribs 11 and 12, and preferably being clamped in there. The meandering shape in each case results in a gap 13 at the rear, which corresponds to the next meander with the next contact element 3, thus allowing mobility of the contact elements 3. The contact elements 3 are clamped in in the front meanders, which face the current receiving device 5.

In addition, the contact elements 3 in the front area are each surrounded by an elastic sheath 14 in order to improve the conduction, but without losing elasticity, which elastic sheath 14 extends to a point shortly in front of the contact surfaces 15 of each contact element 3.

The elastic sheath 14 can be applied or introduced, for example in the form of plastic, by injection molding. The elastic sheath may, of course, also be applied in a different manner, for example in a prefabricated manner, with the contact elements then being introduced in an appropriate manner into the plastic. In this case as well, any desired lengths of the frame which is in the form of an array and is formed in this way are possible.

The frame 10 in the form of an array is connected to a pressing link 16 on its rear face in a manner which is not illustrated in any more detail, for example by adhesive bonding. Instead of being connected on its rear face. Other refinements can also be provided, of course, within the scope of the invention instead of a frame in the form of an array. The only major feature is that a large number of contact elements 3 are arranged one behind the other in the form of an array in an elastic sheath.

The pressing link 16 may be elastic or slightly concave, in the form of a rubber link, and is arranged in an appropriate manner in the transmitter housing 12 between the two magnet bodies 4, so that it extends over the entire length of the frame 10 in the form of an array.

The elastic sheath 14, the air gaps 12 and the pressing link 16 result in a secure surface contact for all the contact elements 3 with the contact elements 9 in the current receiving device 5 when the current transmitter device 1 is being connected to the current receiving device 5. The elastic sheath 14 can also ensure a connection which is moisturetight and watertight. At the same time, it acts as a corset for the contact elements 3, while maintaining elasticity.

As can be seen, this is not dependent on the number of contact elements 3 and 9 which are arranged alongside one another.

In the present exemplary embodiment, the contact elements 3 of the current transmitter device 1 have been arranged elastically in the frame 10 in the form of an array, as described. It is also, of course, evident within the scope of the invention that the current receiving device 5 can also be provided with appropriately elastically arranged contact elements 9 as an alternative to this, while the contact elements 3 in the current transmitter device 1 are arranged fixed in the transmitter housing 2. It is likewise also possible to mount all the contact elements 3 and 9 elastically in frames 10 in the form of arrays.

As can be seen from FIG. 2, not only the contact elements 9 but likewise also the contact elements 3 may be in the form of thin sheets with side extensions 17. The current is then supplied or passed on to a load, which is not illustrated, via the side extensions 17 and via supply lines and output lines 18.

The frame 10 in the form of an array may be formed from an elastic plastic part. Brass parts, possibly silver-plated, can be used as simple stamped parts for the contact elements 3 and 9.

For precision mechanical feeding and connection of the current transmitter device 1 to the current receiving device 5, the current transmitter device 1 may be provided with one or more conical cutouts 19, at whose lower end one magnet body 4 is in each case located. Conversely, the current receiving device 5 has one or more conical projections 20, which are matched to the cone angle of the conical cutouts 19. One magnet body 7 is in each case located in each conical projection 20. For electrical connection, the conical projections 20 are inserted in an appropriately self-centering form into the conical cutouts 19, with the magnet bodies 4 and 7 resting on one another at the end of the insertion process, and the contact connections between the contact elements 3 and 9 in this case being produced such that they are robust and secure. This refinement effectively results in a "blind" contact between the contact elements 3 and 9 without any possibility of faults or errors.

When it is intended to transmit very heavy currents, two contact elements 3 located alongside one another can be connected to one another by means of a conductive contact link 21 (see the dashed illustration in FIG. 1). The same then applies to the contact elements 9 which interact in this way. A contact link 21 can also be used for situations in which two (or more with longer contact links) identical output currents are intensively passed on from a common input current, or vice versa.

Further protection against bad connections or incorrect connections or contact between current transmitter devices 1 and current receiving devices 5 which do not match one another is achieved by "coding" the magnet bodies 4 and 7. "Coding" means that each magnet body is formed from two or more small individual magnets of different polarity, with the mutually opposite magnet bodies 7 and 4 each being arranged to have opposite polarity. Coding such as this can be seen, for example, in FIG. 3 in WO 01/03249 A1. Magnets coded in this way are also described in EP 0 573 471 (Oct. 12, 1994). This means that a contact connection can be made only when the correctly coded magnets meet one another.

The exemplary embodiment described above is described in conjunction with the magnet bodies 4 and 7. The magnet bodies 4 and 7 may, if necessary, also be omitted, of course, and, after the current receiving or data receiving device has been fitted to the current or data transmitter device, a connection or holding force between the two devices can also be provided in some other way, for example by locks or latches.

The invention claimed is:

1. An electrical connecting device comprising:

a) a current or data transmitter device, which connectable to at least one current-transmitting or pulse-transmitting source, is arranged in a transmitter housing and has contact elements;

b) a current receiving or data receiving device, which is electrically connected to a load or a consumer, is arranged in a receiver housing and has contact elements;

c) at least the contact elements in one of the current receiving or the data receiving device are arranged in an at least partially elastic wall of the associated housing;

d) a current, pulse or data transfer can be produced between the contact elements, which are in the form of flat contacts with touching surfaces of the current or data transmitter device and the current receiving or data receiving device by connection of the current or data transmitter device to the current receiving or data receiving device;

e) a number of contact elements of at least one of the two devices are arranged alongside a one another in a configuration (10) in the form of an array formed by a frame (10);

f) the contact elements (3) which are inserted into the configuration in the form of an array are elastically mounted; and g) the configuration in the form of an array rests on an elastic pressing link (16) on the side facing away from the contact elements (3).

2. The electrical connecting device according to claim 1, wherein the contact elements (3) are at least partially embedded in an elastic sheath (14).

3. The electrical connecting device according to claim 1, wherein the current or data transmitter device (1) and the current receiving or data receiving device (5) are each provided with magnet bodies (4, 7), and the magnet bodies (7) for the current receiving or data receiving device (5) are arranged opposite the magnet bodies (4) of the current transmitter or data transmitter device (1).

4. The electrical connecting device according to claim 1, wherein the configuration in the form of an array is formed by a frame (10).

5. The electrical connecting device according to claim 1, wherein the elastic sheath (14) is formed by molding.

6. The electrical connecting device according to claim 1, wherein the elastic pressing link (16) comprises hard rubber or a substance similar to hard rubber.

7. The electrical connecting device according to claim 1, wherein two of the contact elements (3) located alongside one another are connected to one another by a conductive link part (21) in order to enlarge the flat contact.

8. The electrical connecting device according to claim 3, wherein the magnet bodies (4) are in the form of magnets (7) which are reinforced by iron casings (8).

9. The electrical connecting device according to claim 1, wherein the magnet bodies (4) are in the form of magnets, and are each coded by splitting within a magnet into two or more magnet parts of different polarity.

10. The electrical connecting device according to claim 3, wherein the magnet bodies (4) which can be arranged opposite one another in the current or data transmitter device (1) and in the current receiving or data receiving device (5) are passed through guides (19, 20) in the transmitter housing (2) and in the receiver housing (6) for connection.

11. The electrical connecting device according to claim 10, wherein the guides (19, 20) are conical.

12. The electrical connecting device according to claim 1, wherein me current or data transmitter device (1) can be connected to the current receiving or data receiving device (5) by connecting mechanical connecting elements to one another.

* * * * *

UNITED STATES PATENT AND TRADEMARK OFFICE

CERTIFICATE OF CORRECTION

PATENT NO. : 7,097,461 B2
APPLICATION NO. : 10/527478
DATED : August 29, 2006
INVENTOR(S) : Hermann Neidlein It is certified that error appears in the above-identified patent and that said Letters Patent is hereby corrected as shown below:

TITLE Page ITEM
(73) Assignee: Change "Magcode AG" to --MagCode AG--;

Column 5, line 53:
Change "arranged alongside a one" to --arranged alongside one--;

Column 6, line 22:
Change "to claim 1" to --to claim 2--; and

Column 6, line 49:
Change "wherein me current" to --wherein the current--.

Signed and Sealed this

Ninth Day of January, 2007

JON W. DUDAS
*Director of the United States Patent and Trademark Office*